US008446336B2

(12) United States Patent
Lee

(10) Patent No.: US 8,446,336 B2
(45) Date of Patent: May 21, 2013

(54) MULTI-DIRECTIONAL PIVOTING ANTENNA

(75) Inventor: Shin-Ching Lee, Taoyuan County (TW)

(73) Assignee: GemTek Technology Co., Ltd., Hsinchu County (TW)

( * ) Notice: Subject to any disclaimer, the term of this patent is extended or adjusted under 35 U.S.C. 154(b) by 214 days.

(21) Appl. No.: 13/162,788

(22) Filed: Jun. 17, 2011

(65) Prior Publication Data

US 2012/0050132 A1 Mar. 1, 2012

(30) Foreign Application Priority Data

Aug. 24, 2010 (TW) ..... 99128202 A

(51) Int. Cl.
*H01Q 1/50* (2006.01)

(52) U.S. Cl.
USPC ..... 343/906; 343/702; 343/882

(58) Field of Classification Search
USPC ..... 343/702, 906, 882
See application file for complete search history.

(56) References Cited

U.S. PATENT DOCUMENTS

| | | | | |
|---|---|---|---|---|
| 6,710,747 | B1 * | 3/2004 | Chang | 343/702 |
| 7,400,301 | B2 * | 7/2008 | Chan | 343/702 |
| 7,532,167 | B2 * | 5/2009 | Liang et al. | 343/702 |
| 2008/0165078 | A1 * | 7/2008 | Song | 343/906 |
| 2010/0090926 | A1 * | 4/2010 | Li | 343/882 |

* cited by examiner

*Primary Examiner* — Dieu H Duong
(74) *Attorney, Agent, or Firm* — Muncy, Geissler, Olds & Lowe, PLLC

(57) ABSTRACT

A multi-directional pivoting antenna includes an antenna case, a pivotal device, and a pivot base. The antenna case is pivotally connected to the pivotal device and can be vertically turned relative to the pivotal device, and the pivotal device is fitted in the pivot base and can be horizontally turned relative to the pivot base. Therefore, when the pivot base of the pivoting antenna is mounted on an electronic device for wireless signal transmission, the pivotal device and the pivot base provide the pivoting antenna with high degrees of freedom, allowing the antenna case to be pivotally turned horizontally and vertically to different angular positions and directions, and making the pivoting antenna very convenient to use.

10 Claims, 10 Drawing Sheets

MULTI-DIRECTIONAL PIVOTING ANTENNA

FIELD OF THE INVENTION

The present invention relates to a multi-directional pivoting antenna, and more particularly to an antenna structure that has high degrees of freedom and can be pivotally turned vertically and horizontally to different angular positions during operation.

BACKGROUND OF THE INVENTION

Due to the progress in scientific and technological fields, wireless signal transmission has been widely applied to the transmission of electronic signals. A wireless signal antenna is usually required as a medium to enable the wireless signal transmission. For example, in most cases, a wireless network modem is provided with a wireless signal antenna outward projected from a case of the modem.

Most of the currently available antennas for mounting on an electronic apparatus are elongated members. For a user to conveniently adjust the elongated antenna to a desired direction for best signal transmission, the antenna is usually pivotally turnable relative to the electronic apparatus. That is, the antenna can be closely attached to the case of the electronic apparatus, or be pivotally turned to erect on the electronic apparatus, or be pivotally turned toward any specific direction. However, the current pivotable connection structure for the antenna and the electronic apparatus is quite simple and rough in design and can only provide a limited pivoting function. More particularly, the current pivotable connection structure for antenna is mainly based on the friction between tightly connected components of the antenna and the electronic apparatus. Such friction tends to decrease when the antenna has been pivotally turned many times over a long period of time. As a result, the antenna would become loose on the electronic apparatus and could not be effectively located for orienting toward a desired direction. The currently available pivoting antenna also has low degrees of freedom, preventing the user from adjusting the antenna within a wide range of angles. Under this circumstance, the user might need to troublesomely turn or move the electronic apparatus to different direction or position. It is therefore tried by the inventor to develop a multi-directional pivoting antenna to overcome the drawbacks in the conventional pivoting antenna.

SUMMARY OF THE INVENTION

A primary object of the present invention is to provide a multi-directional pivoting antenna to overcome the problems existed in the conventional pivoting antenna.

To achieve the above and other objects, the multi-directional pivoting antenna according to an embodiment of the present invention includes an antenna case, a pivotal device, and a pivot base.

The antenna case has an antenna unit received therein, and is provided at a proximal end with a rearward opened recess to provide a pivoting space thereat. A wall portion of the antenna case corresponding to the pivoting space is upward extended to provide a holding plate, which has a free end formed into a first engaging part, such that the holding plate and the antenna case cooperatively define a holding space therebetween. And, the antenna case is provided on at least a wall portion corresponding to at least one of two lateral sides of the pivoting space with a receiving slot. The pivotal device is correspondingly pivotally connected to the proximal end of the antenna case, and includes a pivot block, a seat, and a pivot post. The pivot block has a top portion pivotally turnably received in the holding space defined between the antenna case and the holding plate for the holding plate to bear thereon. The top portion of the pivot block is provided with a plurality of circumferentially spaced second engaging parts, which are externally configured corresponding to the first engaging part. The pivot block is provided on at least one of two lateral ends with an outward extended pivot shaft, which is correspondingly pivotally fitted in the at least one receiving slots on the antenna case. The seat is located below the pivot block and the pivot post is downward extended from one side of the seat opposite to the pivot block. The pivot post is formed on an outer wall surface near the seat with an outward protruded stopper, and on the outer wall surface at a predetermined position with a first friction section. The pivot base is correspondingly fitted around the pivot post of the pivotal device to upward press against the seat. The pivot base is provided with an axial opening, such that the pivot post is tightly but pivotally turnably fitted in the axial opening. A second friction section is provided on a wall surface of the pivot base surrounding the axial opening for engaging with the first friction section on the pivot post. The pivot base is further provided on one side facing toward the seat with a limiting recess, in and along which the stopper moves when the pivot post is pivotally turned in the axial opening. The limiting recess includes a raised limiting portion for stopping the stopper from moving any further when the pivot post is pivotally turned clockwise or counterclockwise, so as to define a maximum range of angles within which the pivot device can be pivotally turned relative to the pivot base.

According to the present invention, the receiving slot is provided on a wall surface with a first frictional unit, and the pivot shaft is provided on an end surface with a plurality of radially arranged second frictional units; the second frictional units are angularly spaced by an angle corresponding to that by which the second engaging parts on the pivot block are circumferentially spaced from one another; and the first frictional unit can be correspondingly received in any selected one of the second frictional units. According to the present invention, the pivot post is a hollow post, and is provided on a wall thereof with a plurality of notches extended from a distal end of the pivot post toward the seat. Preferably, the pivotal device is provided with a wiring hole extended through the pivot block and the seat into the pivot post for a lead of the antenna unit to pass therethrough, and a lead protection annular wall is downward extended from the seat into the pivot post to be located around the wiring hole. And, the holding plate is provided with a notch, via which the lead of the antenna unit can be extended.

According to the present invention, the first friction section is a sideward protrusion and the second friction section includes a plurality of grooves; the antenna case can be assembled from a first half case and a second half case to form a complete case; and the holding plate has a certain degree of elasticity and has a rearward curved free end.

With the above structural design, the multi-directional pivoting antenna of the present invention provides high degrees of freedom to allow a user to pivotally turn the antenna case vertically and horizontally in multiple directions. To use the pivoting antenna of the present invention, simply mount the pivot base on an electronic apparatus. Then, the pivotal device fitted in the pivot base can be horizontally turned relative to the pivot base, and the antenna case can be vertically turned relative to the pivotal device, so that the pivoting antenna can be very conveniently adjusted to different angular positions and oriented toward different directions.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
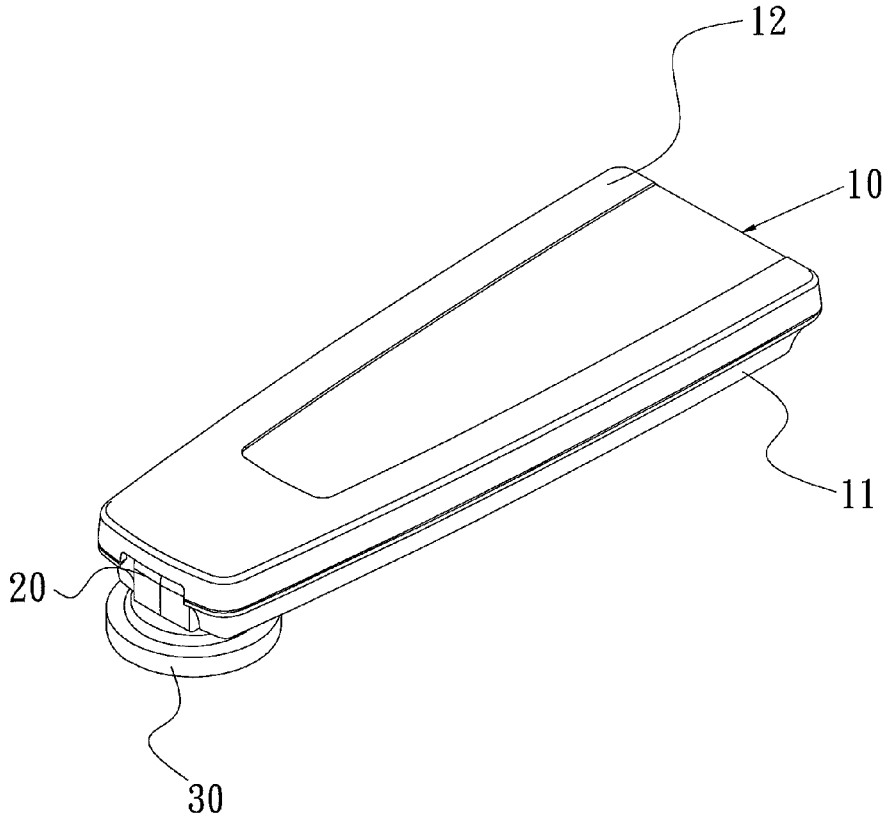
FIG. 1 is an assembled top perspective view of a multi-directional pivoting antenna according to a preferred embodiment of the present invention.
Figure 2:
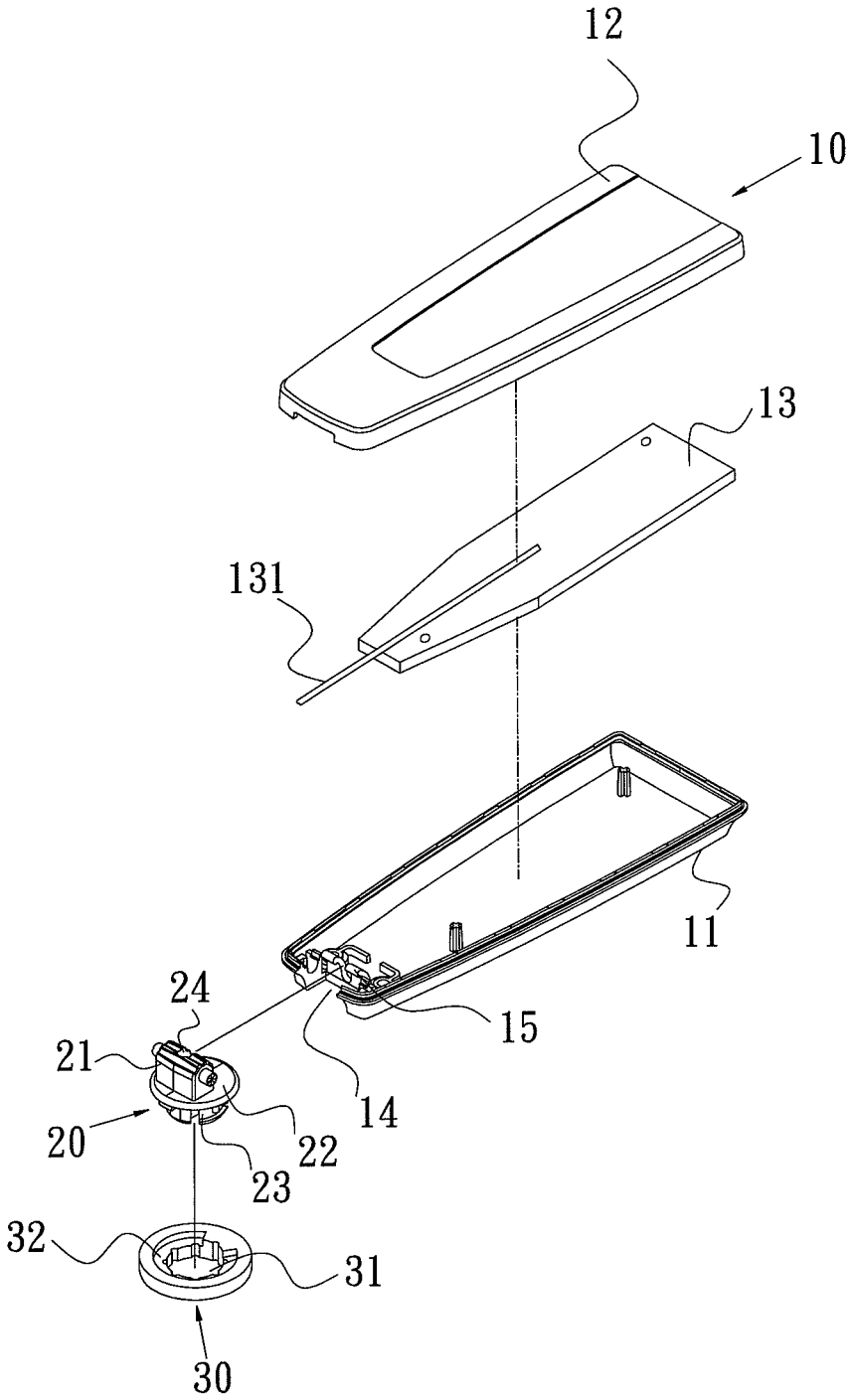
FIG. 2 is an exploded top perspective view of FIG. 1.
Figure 3:
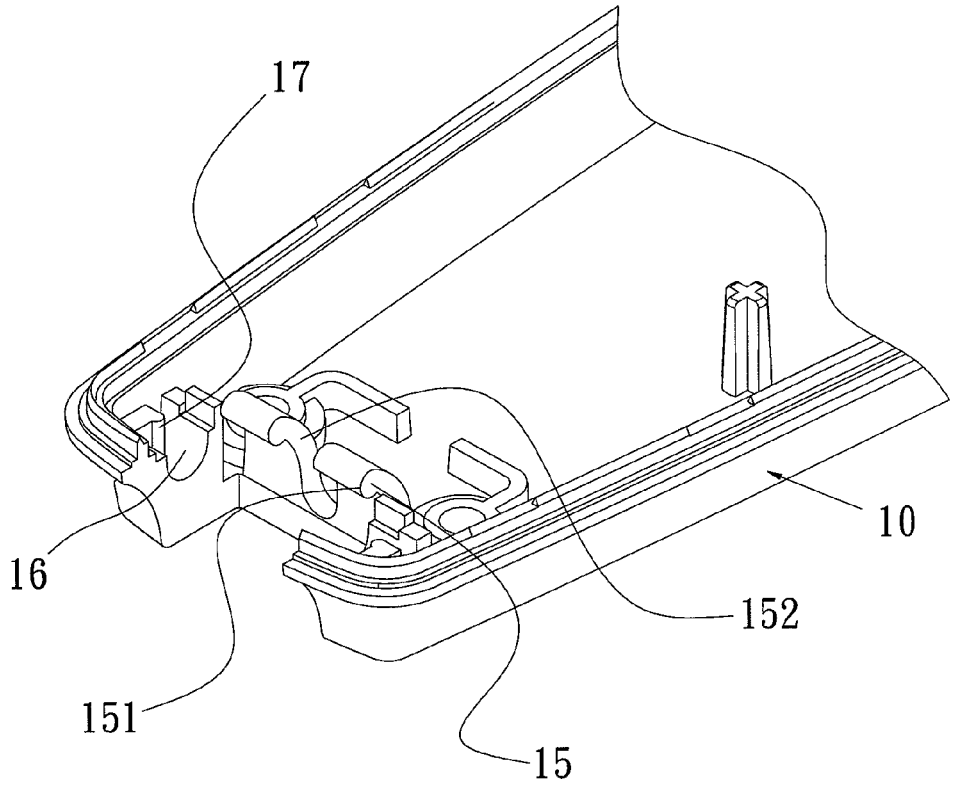
FIG. 3 is a fragmentary perspective view of an antenna case of the multi-directional pivoting antenna according to the present invention.
Figure 4:
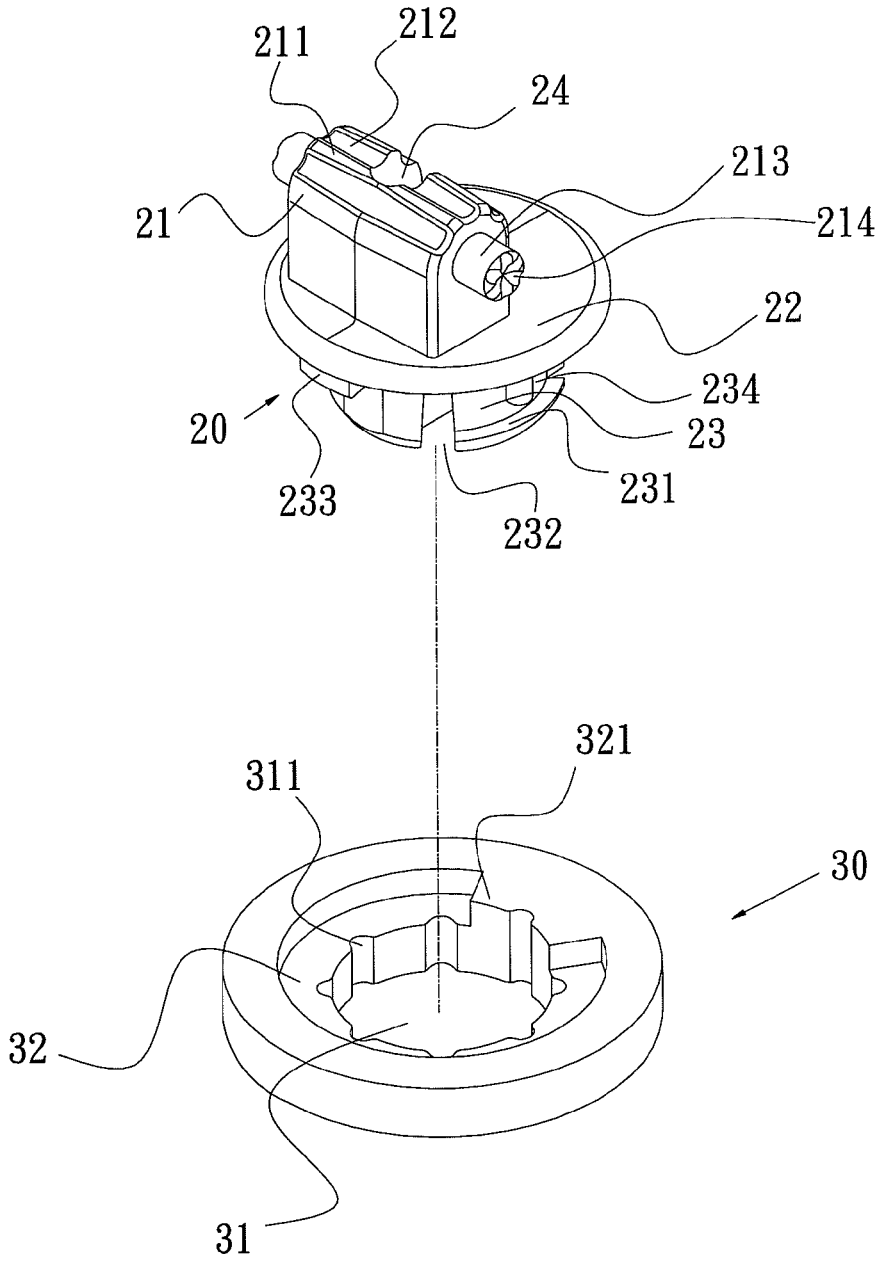
FIG. 4 is an exploded top perspective view showing a pivotal device and a pivot base of the multi-directional pivoting antenna according to the present invention.
Figure 5:
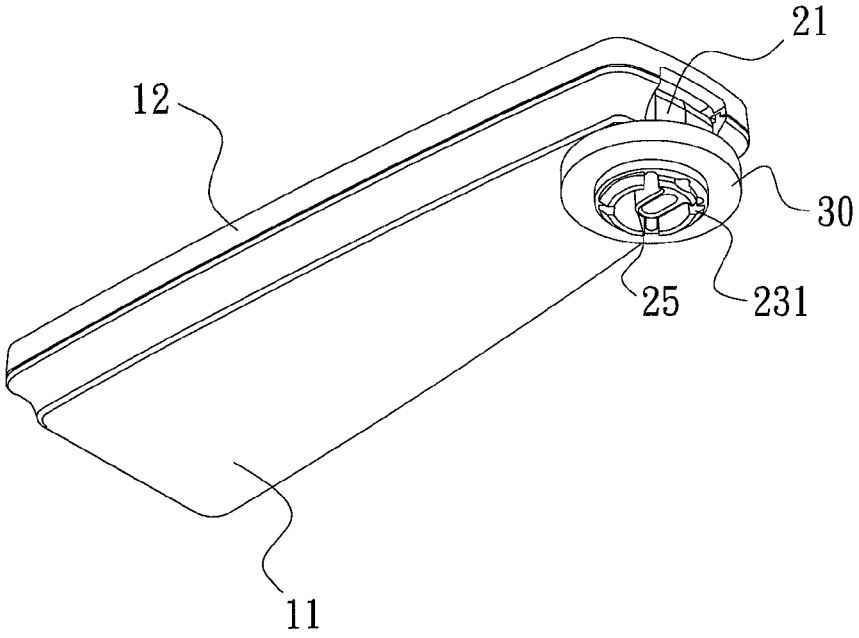
FIG. 5 is an assembled bottom perspective view of the multi-directional pivoting antenna according to the preferred embodiment of the present invention.
Figure 6:
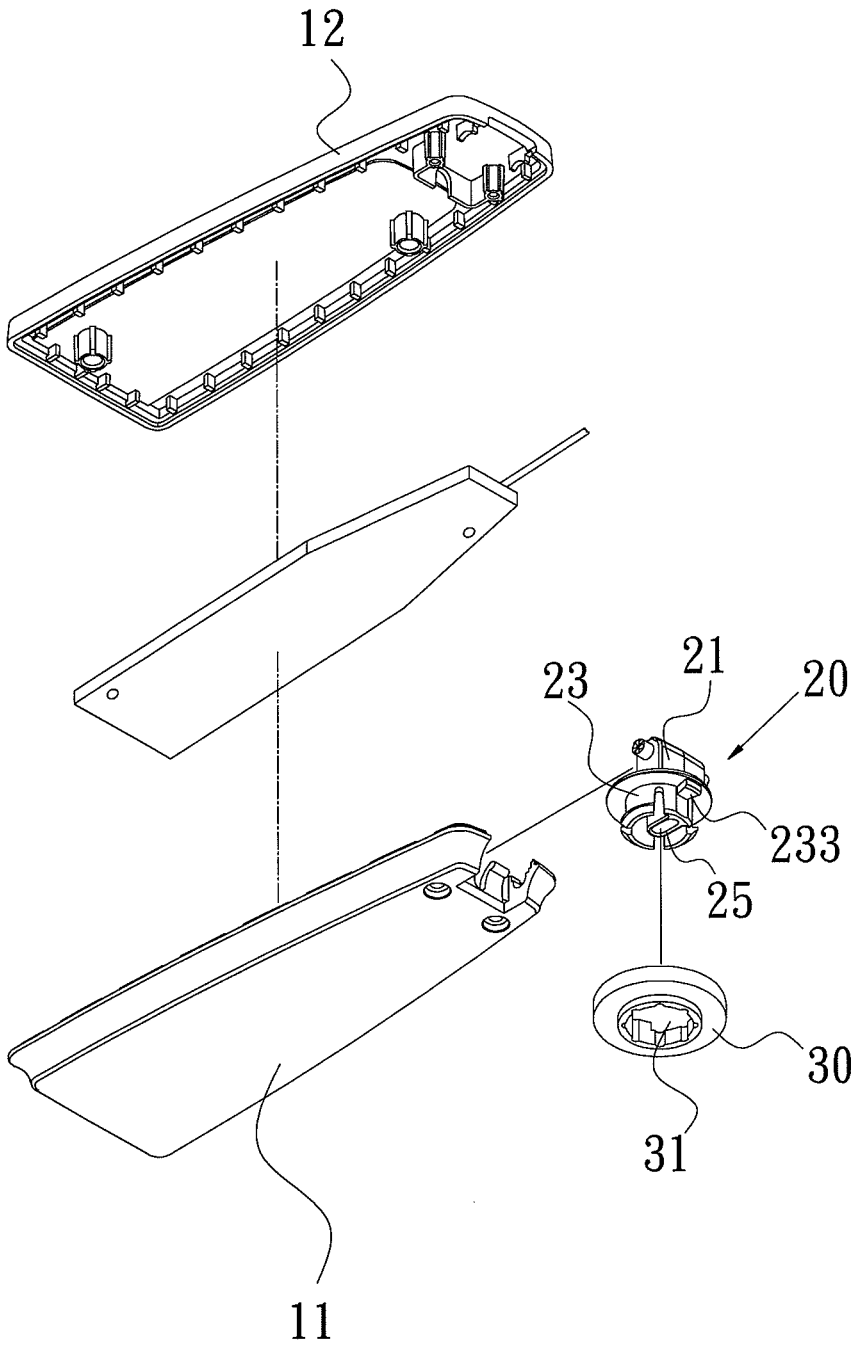
FIG. 6 is an exploded bottom perspective view of FIG. 5.
Figure 7:
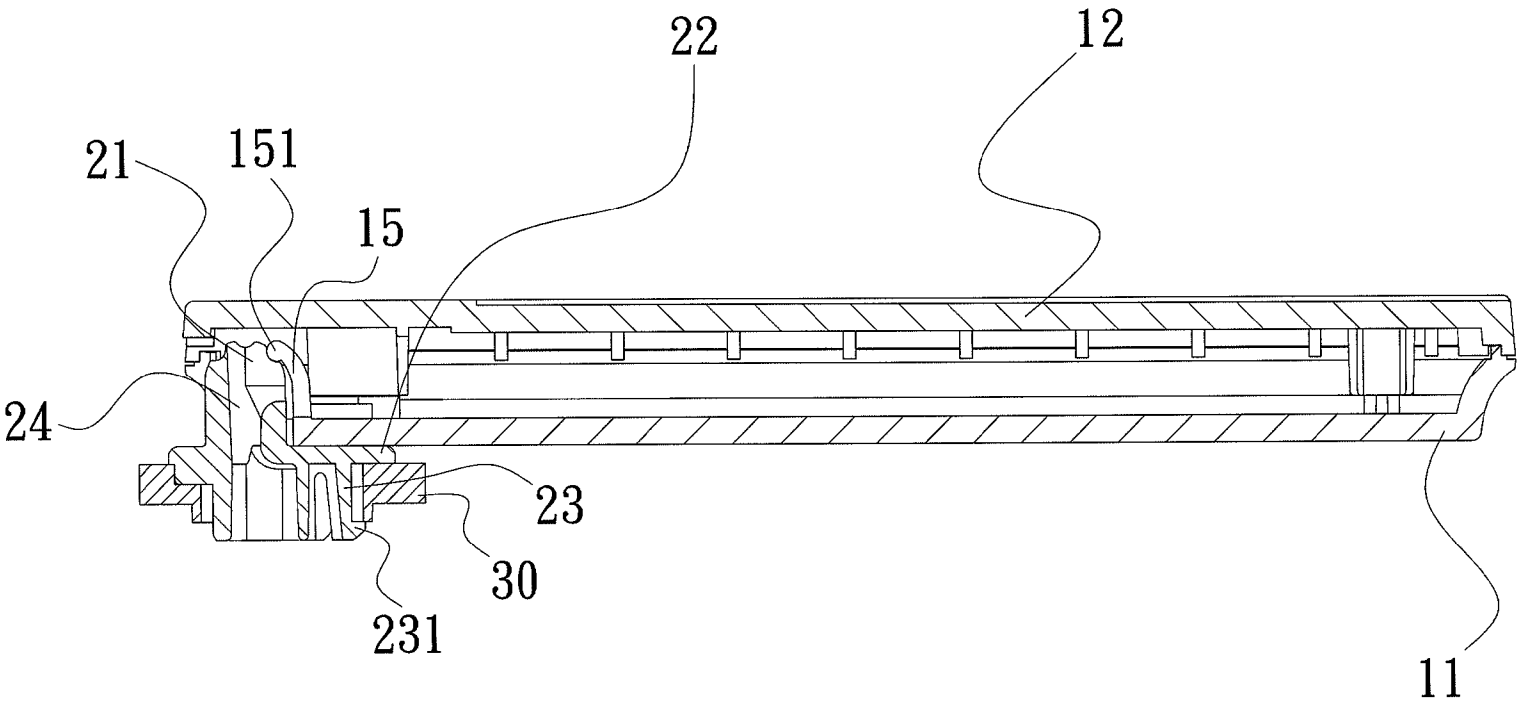
FIG. 7 is an assembled sectional side view of the multi-directional pivoting antenna according to the preferred embodiment of the present invention.

The present invention will now be described with a preferred embodiment thereof. For the purpose of easy to understand, elements that are the same in the preferred embodiment are denoted by the same reference numerals. It is understood the accompanying drawings are illustrated only for assisting in describing the present invention and are not necessarily in compliance with the exact or precise size proportion and part arrangement of a real product manufactured through implementing the present invention. Therefore, the size proportion and part arrangement shown in the accompanying drawings are not intended to limit the present invention, which is intended to be limited only by the appended claims.

Please refer to FIG. 1. A multi-directional pivoting antenna according to a preferred embodiment of the present invention includes an antenna case 10, a pivotal device 20, and a pivot base 30.

Please refer to FIGS. 2 to 7 along with FIG. 1. The antenna case 10 can be a case assembled from a first half case 11 and a second half case 12 for receiving an antenna unit 13 therein. A proximal end of the antenna case 10, preferably a proximal end of the first half case 11, is formed into a rearward opened recess to provide a pivoting space 14 thereat. A wall portion of the first half case 11 of the antenna case 10 corresponding to the pivoting space 14 is upward extended to provide a holding plate 15, which has a certain degree of elasticity and has a rearward curved free end to form a first engaging part 151. The holding plate 15 and the antenna case 10 cooperatively define a holding space therebetween. The holding plate 15 is also provided with a notch 152, via which a lead 131 of the antenna unit 13 can be extended. Wall portions of the first half case 11 corresponding to two lateral sides of the pivoting space 14 are respectively formed with a receiving slot 16, and a first frictional unit 17 is protruded from a wall surface of each of the receiving slots 16.

Figure 8:
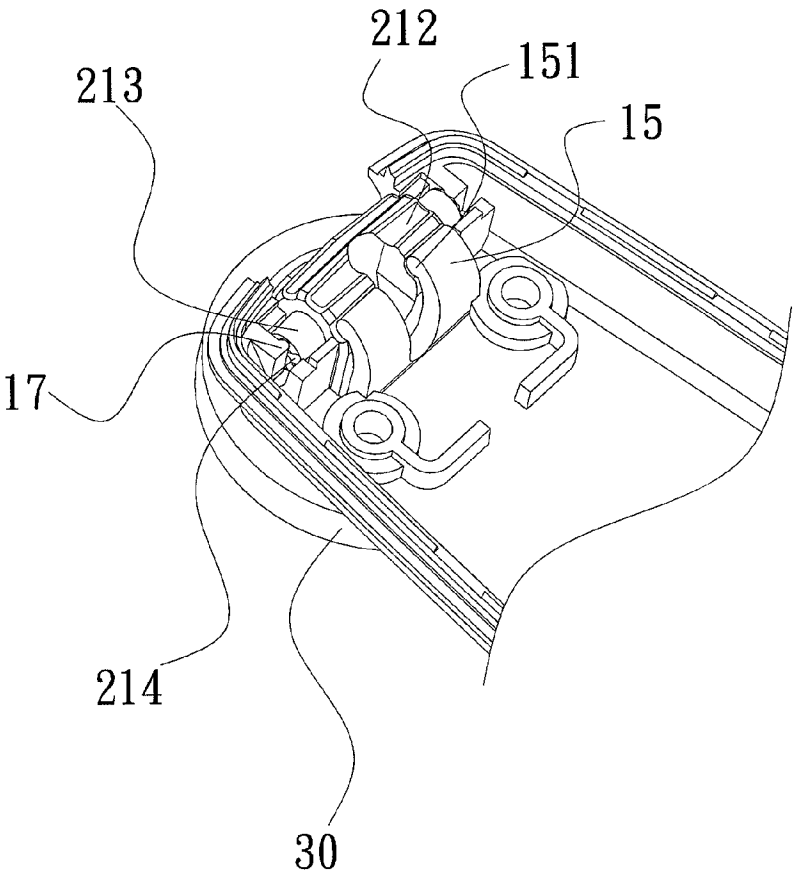
FIG. 8 is a fragmentary and partially assembled top perspective view of the present invention.
Figure 9:
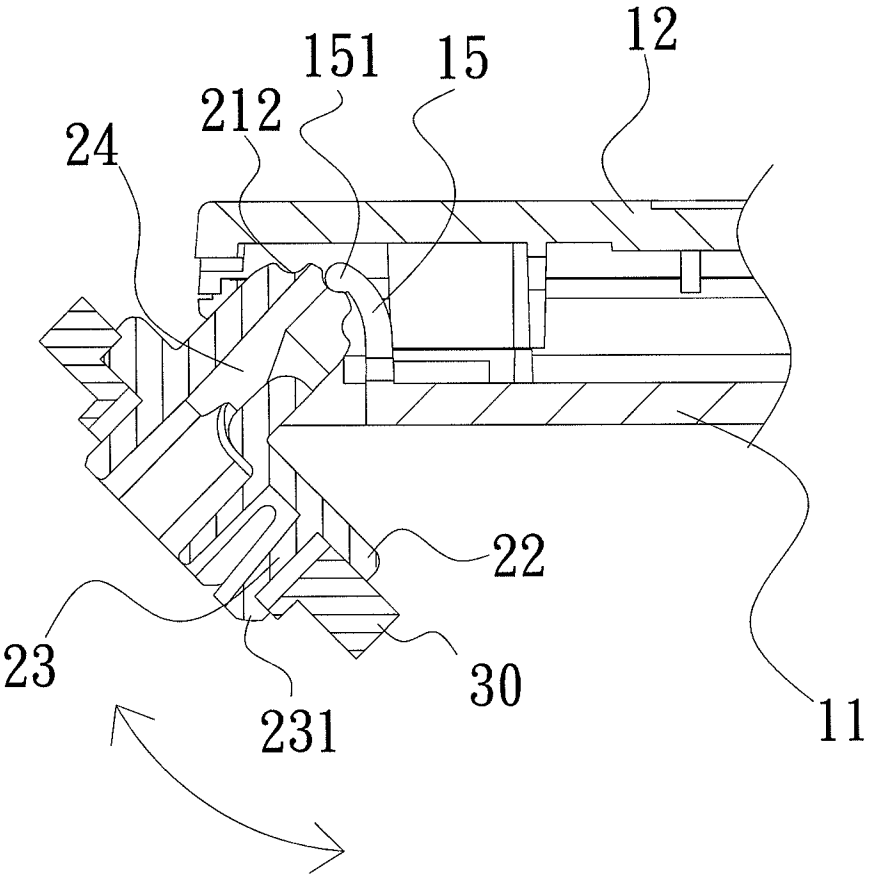
FIG. 9 is a fragmentary assembled sectional side view showing the use of the present invention.
Figure 10:
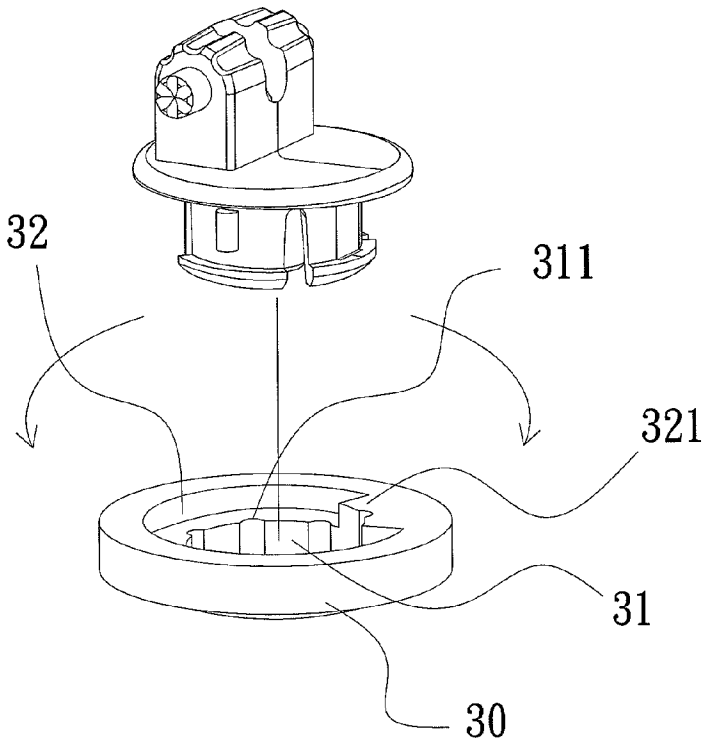
FIG. 10 is an exploded perspective view showing the manner in which the pivotal device can be pivotally turned in and relative to the pivot base.

Please also refer to FIGS. 8 to 10. The pivotal device 20 is correspondingly pivotally connected to the proximal end of the antenna case 10, and includes a pivot block 21, a seat 22, and a pivot post 23. The pivot block 21 has a top portion 211 that is rotatably received in the holding space defined between the antenna case 10 and the holding plate 15 for the holding plate 15 to bear thereon. On the top portion 211 of the pivot block 21, there is provided a plurality of circumferentially spaced second engaging parts 212. The second engaging parts 212 are externally configured corresponding to the first engaging part 151, so as to engage with the first engaging part 151 while providing a degree of friction between them, allowing the antenna case 10 to be vertically pivotally turned and located at a specific angular position relative to the pivotal device 20. The pivot block 21 is provided at two lateral ends with two outward extended pivot shafts 213, which are correspondingly pivotally fitted in the two receiving slots 16. The pivot shafts 213 are respectively provided on an end surface with a plurality of radially arranged second frictional units 214. The second frictional units 214 are angularly spaced corresponding to the circumferentially spaced second engaging parts 212, and are able to receive the first frictional units 17 therein, so that the first and the second frictional units 17, 214 together provide a degree of friction between them, which also allows the antenna case 10 to be pivotally turned and located at a specific angular position relative to the pivotal device 20.

The seat 22 of the pivotal device 20 is located below the pivot block 21, and the pivot post 23 is downward extended from one side of the seat 22 opposite to the pivot block 21. The pivot post 23 can be a hollow post, and is externally provided around a distal end with a radially outward extended hooking flange 231. The pivot post 23 is also provided on a wall thereof with a plurality of spaced notches 232, which extend from the distal end toward the seat 22. An outward protruded stopper 233 is formed on an outer wall surface of the pivot post 23 near the seat 22, and a first friction section 234 in the form of a sideward protrusion is further provided on the outer wall surface of the pivot post 23. Further, the pivotal device 20 is provided with a wiring hole 24 extended through the pivot block 21 and the seat 22 into the pivot post 23 for the lead 131 to pass therethrough. As can be seen from FIG. 6, a lead protection annular wall 25 is downward extended from the seat 22 into the pivot post 23 to be located around the wiring hole 24, so as to prevent the lead 131 from moving into any of the notches 232 when the antenna case 10 is pivotally turned relative to the pivotal device 20.

The pivot base 30 is correspondingly fitted around the pivot post 23 of the pivotal device 20 to upward press against the seat 22 and has a through hole defining an axial opening 31 corresponding to the pivot post 23, such that the pivot post 23 is tightly but pivotally turnably fitted in the axial opening 31 with the hooking flange 231 bearing on a bottom of the pivot base 30. A second friction section 311 is provided on a wall surface of the pivot base 30 surrounding the axial opening 31. The second friction section 311 may include a plurality of circumferentially spaced grooves. When the pivot base 30 is tightly fitted around the pivot post 23 with the first friction section 234 on the pivot post 23 engaged with the second friction section 311, an increased frictional force can be produced between the pivotal device 20 and the pivot base 30 when the former is pivotally turned relative to the latter. The pivot base 30 is further provided on one side facing toward the seat 22 with a limiting recess 32, in and along which the stopper 233 moves when the pivot post 23 is pivotally turned in the axial opening 31. The limiting recess 32 includes a raised limiting portion 321. When the stopper 233 moves in the limiting recess 32 clockwise or counterclockwise and touches any one of two ends of the raised limiting portion 321, the stopper 233 is stopped by the limiting portion 321 from moving any further to thereby define the maximum range of angles within which the pivot device 20 can be pivotally turned relative to the pivot base 30.

To use the multi-directional pivoting antenna according to the present invention, first mount the pivot base 30 on an electronic apparatus, such as a wireless network modem. With the structural design of the present invention, the antenna case 10 can be horizontally turned about the pivot base 30 relative to the electronic apparatus and/or vertically turned about the pivot shafts 213 of the pivotal device 20 relative to the electronic apparatus. Therefore, the pivoting antenna of the present invention provides high degrees of freedom and the antenna unit can be pivotally turned within a wide range of angles and directions.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A multi-directional pivoting antenna, comprising:

an antenna case having an antenna unit received therein; the antenna case being provided at a proximal end with a rearward opened recess to provide a pivoting space thereat, and a wall portion of the antenna case corresponding to the pivoting space being upward extended to provide a holding plate, which has a free end formed into a first engaging part, such that the holding plate and the antenna case cooperatively define a holding space therebetween; and the antenna case being provided on at least a wall portion corresponding to at least one of two lateral sides of the pivoting space with a receiving slot;

a pivotal device being correspondingly pivotally connected to the proximal end of the antenna case, and including a pivot block, a seat, and a pivot post; the pivot block having a top portion pivotally turnably received in the holding space defined between the antenna case and the holding plate for the holding plate to bear thereon; the top portion of the pivot block being provided with a plurality of circumferentially spaced second engaging parts, which are externally configured corresponding to the first engaging part; the pivot block being provided on at least one of two lateral ends with an outward extended pivot shaft, which is correspondingly pivotally fitted in the at least one receiving slots on the antenna case; the seat being located below the pivot block and the pivot post being downward extended from one side of the seat opposite to the pivot block; and the pivot post being formed on an outer wall surface near the seat with an outward protruded stopper, and on the outer wall surface at a predetermined position with a first friction section; and a pivot base being correspondingly fitted around the pivot post of the pivotal device to upward press against the seat; the pivot base being provided with an axial opening, such that the pivot post is tightly but pivotally turnably fitted in the axial opening; a second friction section being provided on a wall surface of the pivot base surrounding the axial opening for engaging with the first friction section on the pivot post; the pivot base being further provided on one side facing toward the seat with a limiting recess, in and along which the stopper moves when the pivot post is pivotally turned in the axial opening; and the limiting recess including a raised limiting portion for stopping the stopper from moving any further when the pivot post is pivotally turned clockwise or counterclockwise, so as to define a maximum range of angles within which the pivot device can be pivotally turned relative to the pivot base.

2. The multi-directional pivoting antenna as claimed in claim 1, wherein the receiving slot is provided on a wall surface with a first frictional unit, and the pivot shaft is provided on an end surface with a plurality of radially arranged second frictional units; the second frictional units being angularly spaced by an angle corresponding to that by which the second engaging parts on the pivot block are circumferentially spaced from one another; and the first frictional unit being correspondingly received in any selected one of the second frictional units.

3. The multi-directional pivoting antenna as claimed in claim 1, wherein the pivot post is a hollow post.

4. The multi-directional pivoting antenna as claimed in claim 3, wherein the pivot post is provided on a wall thereof with a plurality of notches extended from a distal end of the pivot post toward the seat.

5. The multi-directional pivoting antenna as claimed in claim 4, wherein the pivotal device is provided with a wiring hole extended through the pivot block and the seat into the pivot post for a lead of the antenna unit to pass therethrough, and a lead protection annular wall is downward extended from the seat into the pivot post to be located around the wiring hole.

6. The multi-directional pivoting antenna as claimed in claim 1, wherein the holding plate is provided with a notch, via which a lead of the antenna unit is extended.

7. The multi-directional pivoting antenna as claimed in claim 1, wherein the pivot post has a distal end provided with a radially outward extended hooking flange.

8. The multi-directional pivoting antenna as claimed in claim 1, wherein the first friction section is a sideward protrusion and the second friction section includes a plurality of grooves.

9. The multi-directional pivoting antenna as claimed in claim 1, wherein the antenna case is assembled from a first half case and a second half case to form a complete case.

10. The multi-directional pivoting antenna as claimed in claim 1, wherein the holding plate has a certain degree of elasticity and has a rearward curved free end.

* * * * *